US009033765B2

(12) United States Patent
Woo et al.

(10) Patent No.: US 9,033,765 B2
(45) Date of Patent: May 19, 2015

(54) COATED ABRASIVE ARTICLE AND METHODS OF ABLATING COATED ABRASIVE ARTICLES

(75) Inventors: Edward J. Woo, Woodbury, MN (US); Pingfan Wu, Woodbury, MN (US); Patrick R. Fleming, Lake Elmo, MN (US); Ian R. Owen, Baldwin, WI (US); Schoen A. Schuknecht, Hudson, WI (US); Frederick P. LaPlant, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 493 days.

(21) Appl. No.: 13/377,743

(22) PCT Filed: Jul. 23, 2010

(86) PCT No.: PCT/US2010/042998

§ 371 (c)(1),
(2), (4) Date: Dec. 12, 2011

(87) PCT Pub. No.: WO2011/017022

PCT Pub. Date: Feb. 10, 2011

(65) Prior Publication Data

US 2012/0122383 A1 May 17, 2012

Related U.S. Application Data

(60) Provisional application No. 61/229,091, filed on Jul. 28, 2009.

(51) Int. Cl.

| | |
|---|---|
| ***B24D 11/04*** | (2006.01) |
| ***B41M 5/26*** | (2006.01) |
| ***B24D 11/02*** | (2006.01) |

(52) U.S. Cl.
CPC ..... *B24D 11/04* (2013.01); *B41M 5/267* (2013.01); *B24D 11/02* (2013.01)

(58) Field of Classification Search
CPC ..... B24D 11/02; B41M 5/267
USPC ..... 451/54–56
See application file for complete search history.

(56) References Cited

U.S. PATENT DOCUMENTS

| | | | |
|---|---|---|---|
| 4,734,104 | A | 3/1988 | Broberg |
| 4,737,163 | A | 4/1988 | Larkey |

(Continued)

FOREIGN PATENT DOCUMENTS

| | | |
|---|---|---|
| EP | 0745020 | 7/1999 |
| JP | 1-159178 | 6/1989 |

(Continued)

OTHER PUBLICATIONS

International Search Report, PCT/US2010/042998, mailed Mar. 2, 2011, 3 pages.

*Primary Examiner* — Maurina Rachuba
(74) *Attorney, Agent, or Firm* — Bradford B. Wright

(57) ABSTRACT

A coated abrasive article comprises an abrasive layer secured to a backing. The abrasive layer comprises abrasive particles secured by at least one binder to a first major surface of the backing. A supersize is disposed on at least a portion of the abrasive layer. The coated abrasive article has a melt flow zone adjacent to an edge of the coated abrasive article, wherein the melt flow zone has a maximum width of less than 100 micrometers, and the melt flow zone has a maximum height of less than 40 micrometers. Methods of using infrared lasers to ablate coated abrasive articles are also disclosed, wherein a laser wavelength is matched to a component of the coated abrasive article.

18 Claims, 3 Drawing Sheets

(56) References Cited

U.S. PATENT DOCUMENTS

| | | | | |
|---|---|---|---|---|
| 4,751,138 | A | 6/1988 | Tumey et al. | |
| 5,010,231 | A * | 4/1991 | Huizinga | 219/121.69 |
| 5,152,917 | A | 10/1992 | Pieper et al. | |
| 5,203,884 | A | 4/1993 | Buchanan et al. | |
| 5,256,170 | A | 10/1993 | Harmer et al. | |
| 5,378,251 | A | 1/1995 | Culler et al. | |
| 5,417,726 | A | 5/1995 | Stout et al. | |
| 5,435,816 | A | 7/1995 | Spurgeon et al. | |
| 5,436,063 | A | 7/1995 | Follett et al. | |
| 5,496,386 | A | 3/1996 | Broberg et al. | |
| 5,520,711 | A | 5/1996 | Helmin | |
| 5,609,706 | A | 3/1997 | Benedict et al. | |
| 5,672,097 | A | 9/1997 | Hoopman | |
| 5,681,217 | A | 10/1997 | Hoopman | |
| 5,766,277 | A | 6/1998 | DeVoe et al. | |
| 5,851,247 | A | 12/1998 | Stoetzel et al. | |
| 5,942,015 | A | 8/1999 | Culler et al. | |
| 5,954,844 | A | 9/1999 | Law et al. | |
| 5,961,674 | A | 10/1999 | Gagliardi et al. | |
| 5,975,988 | A | 11/1999 | Christianson | |
| 6,039,775 | A | 3/2000 | Ho et al. | |
| 6,077,601 | A | 6/2000 | DeVoe et al. | |
| 6,139,594 | A | 10/2000 | Kincaid et al. | |
| 6,160,240 | A | 12/2000 | Momma et al. | |
| 6,228,133 | B1 | 5/2001 | Thurber et al. | |
| 6,277,160 | B1 | 8/2001 | Stubbs et al. | |
| 6,821,189 | B1 * | 11/2004 | Coad et al. | 451/41 |
| 7,169,017 | B1 * | 1/2007 | Saikin | 451/6 |
| 7,344,574 | B2 | 3/2008 | Thurber et al. | |
| 7,344,575 | B2 | 3/2008 | Thurber et al. | |
| 2007/0037500 | A1 | 2/2007 | Minick et al. | |
| 2007/0066198 | A1 | 3/2007 | Rambosek et al. | |
| 2008/0216413 | A1 | 9/2008 | Woo et al. | |
| 2008/0216414 | A1 * | 9/2008 | Braunschweig et al. | 51/298 |
| 2009/0017276 | A1 | 1/2009 | Hoglund | |

FOREIGN PATENT DOCUMENTS

| | | | |
|---|---|---|---|
| JP | 05-247234 | A | 9/1993 |
| JP | 07-071788 | B | 8/1995 |
| JP | 2000-246473 | A | 9/2000 |
| JP | 2001-521831 | A | 11/2001 |
| JP | 2008-546555 | T | 12/2008 |
| WO | WO 2007/002338 | | 1/2007 |

* cited by examiner

COATED ABRASIVE ARTICLE AND METHODS OF ABLATING COATED ABRASIVE ARTICLES

CROSS-REFERENCE TO RELATED APPLICATIONS

This application is a national stage filing under 35 U.S.C. 371 of PCT/US2010/042998, filed Jul. 23, 2010, which claims priority to U.S. Provisional Application No. 61/229,091, filed Jul. 28, 2009, the disclosure of which is incorporated by reference in its entirety herein.

TECHNICAL FIELD

The present disclosure broadly relates to coated abrasive articles and methods of ablating them.

BACKGROUND

Coated abrasive articles generally have an abrasive layer, comprising abrasive particles and one or more binders, secured to a major surface of a backing. In many cases, an additional coating called a supersize, typically including a grinding aid, is included over the abrasive layer. The backing and/or abrasive layer may include more than one layer. For example, the backing may be a laminate backing, optionally having one or more backing treatments thereon.

In some coated abrasives, the abrasive layer may include a make layer and abrasive particles embedded in the make layer and covered by a size layer which helps retain the abrasive particles.

In other coated abrasives, abrasive particles are dispersed more or less evenly throughout a polymeric binder. For example, this is commonly the case when the abrasive layer is formed of shaped abrasive composites, typically having a predetermined shape (e.g., a precise shape) and arrangement on the backing. Such abrasives are typically prepared by coating a slurry of a corresponding binder precursor and abrasive particles on a tool having shaped cavities, laminating a backing to the tool, curing the binder precursor to form shaped abrasive composites secured to the backing, and then removing the tool.

It is known in the abrasive arts to use infrared lasers such as, for example, carbon dioxide (i.e., $CO_2$) lasers operating at a wavelength of 10.6 micrometers to convert coated abrasive roll goods into sheets and/or discs suitable for sale to consumers. However, using this converting method (i.e., perforating and/or cutting by infrared laser-induced ablation) with adhesive-backed coated abrasives can lead to edge contamination by the adhesive resulting in difficulty in peeling off the associated release liner. Additionally, pieces of adhesive may become lodged at the interface between the abrasive layer and the workpiece, potentially creating scratches.

The $CO_2$ laser produces a beam of long wave infrared (LWIR) light with the principal wavelength centered between 9.2 and 12 micrometers and tunable within this range. Average output power of $CO_2$ lasers is typically highest at 10.6 micrometers and declines when tuned to other wavelengths. Accordingly, the vast majority of commercial $CO_2$ laser processing is done at a single wavelength, 10.6 micrometers.

In some cases, infrared laser converting can result in hardened, raised, and/or sharp edges being formed in the abrasive layer adjacent to cuts and perforations made by the laser. These hardened edges can also adversely affect the performance of the coated abrasive.

In the case of coated abrasive that include a powdery supersize (e.g., a zinc stearate supersize), infrared laser ablating can result in the abrasive particles becoming covered with melted supersize thereby reducing anti-loading performance of the supersize and potentially inducing scratches on the abraded surface.

SUMMARY

The present disclosure provides solutions to the above-mentioned deficiencies by recognizing that the problems during infrared laser ablating result from excessive heat generation relative to ablation (i.e., vaporization) of the coated abrasive article. Accordingly, the present disclosure provides methods for increasing the rate of ablation (and hence processing efficiency) while reducing the amount of associated heat generation. In general, this is accomplished by using a laser wavelength that is appropriately matched to the absorption profile of the material in the coated abrasive to be ablated.

In some embodiments, the method further comprises:

- obtaining at least a portion of a second absorption spectrum corresponding to a second component of the coated abrasive article;
- providing a second infrared laser beam having a second wavelength different than the first wavelength, wherein the second wavelength is matched to a second absorbance band of the second absorption spectrum, wherein the second component has a second absorbance at the second wavelength of at least 0.01 per micrometer of thickness of the second component;
- ablating a portion of the second component with the second infrared laser beam.

In another aspect, the present disclosure provides a method comprising:

- providing a coated abrasive article comprising abrasive particles secured by at least one binder to a first major surface of a backing;
- providing a first infrared laser beam having a first wavelength, wherein the coated abrasive article has a first component with a first absorbance at the first wavelength of at least 0.01 per micrometer of thickness of the first component;
- ablating a portion of the first component with the first infrared laser beam;
- providing a second infrared laser beam having a second wavelength different than the first wavelength, wherein the coated abrasive article has a second component with a second absorbance at the second wavelength of at least 0.01 per micrometer of thickness of the second component; and
- ablating a portion of the second component with the second infrared laser beam.

In some embodiments, the first infrared laser beam has a first average power of at least 60 watts and a first average beam intensity, wherein the first infrared laser beam is focused to a first spot where the first infrared laser beam contacts the coated abrasive article, wherein a total of all portions of the first spot having an intensity of at least half of the first average beam intensity has an area of less than or equal to 0.3 square millimeters, and wherein the first spot traces a first path on the coated abrasive article at a first rate, relative to the coated abrasive article, of at least 10 millimeters per second.

In some embodiments, the second infrared laser beam has a second average power of at least 60 watts and a second average beam intensity, wherein the second infrared laser beam is focused to a second spot where the second infrared laser beam contacts the coated abrasive article, wherein a total of all portions of the second spot having an intensity of at least half of the second average beam intensity has an area of less than or equal to 0.3 square millimeters, and wherein the second spot traces a second path on the coated abrasive article at a second rate, relative to the coated abrasive article, of at least 10 millimeters per second.

In some embodiments, the second spot traces a second path superposed on the first path. In some embodiments, the second component comprises at least a portion of the at least one binder. In some embodiments, the first component comprises at least a portion of the backing. In some embodiments, the abrasive particles have an average particle diameter in a range of from 3 to 30 micrometers. In some embodiments, the first infrared laser beam is a pulsed laser beam. In some embodiments, the coated abrasive article further comprises a pressure-sensitive adhesive layer disposed on a second major surface of the backing opposite the first major surface.

In yet another aspect, the present disclosure provides a coated abrasive article comprising: an abrasive layer secured to a backing, wherein the abrasive layer comprises abrasive particles secured by at least one binder to a first major surface of the backing; and a supersize disposed on at least a portion of the abrasive layer, wherein the coated abrasive article has a melt flow zone adjacent to an edge of the coated abrasive article, wherein the melt flow zone has a maximum width of less than 100 micrometers, and wherein the melt flow zone has a maximum height of less than 40 micrometers.

In some embodiments, the melt flow zone has a maximum width of less than 80 micrometers, and the melt flow zone has a maximum height of less than 15 micrometers. In some embodiments, the abrasive layer comprises make and size layers. In some embodiments, the abrasive layer comprises a plurality of shaped abrasive composites. In some embodiments, the melt flow zone is caused by an infrared laser beam.

Advantageously, coated abrasive articles ablated according to the present disclosure have little or no problem with adhesive residue as is often seen using conventional laser converting methods as practiced in the coated abrasives art. Further, coated abrasive articles ablated according to the present disclosure generally exhibit reduced adverse scratches caused by hardened residue near edges of the coated abrasive article as is also often seen using conventional laser ablating methods as practiced in the coated abrasives art.

As used herein:

"ablating" means removing by laser-induced vaporization;

"absorbance" refers to the capacity of a substance to absorb electromagnetic radiation, expressed as the common logarithm of the reciprocal of the transmittance;

"edge" in reference to a coated abrasive article refers to a surface that connects opposed major surfaces of a coated abrasive article; for example, at a periphery or adjacent a perforation; and "infrared" refers to electromagnetic radiation in a wavelength range of from 760 nanometers to one millimeter.

DETAILED DESCRIPTION

Coated abrasive articles generally comprise abrasive particles secured by at least one binder to a first major surface of a backing.

Figure 1:
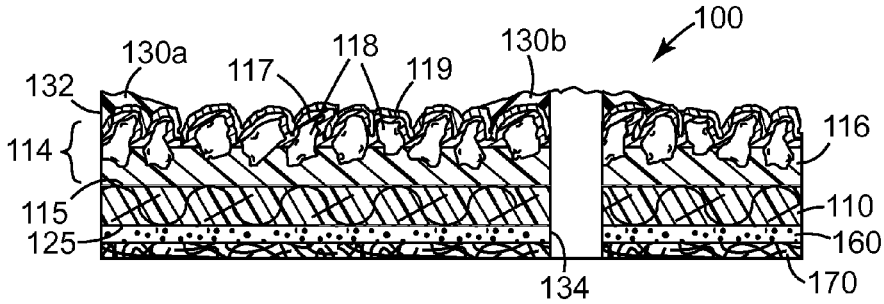
FIG. 1 is a cross-sectional side view of an exemplary coated abrasive article according to the present invention.

In one embodiment, the abrasive particles are secured to the backing by a combination of make and size layers. One such coated abrasive article is illustrated in FIG. 1. Referring now to FIG. 1, exemplary coated abrasive article 100 comprises backing 110. Abrasive layer 114 is secured to first major surface 115 of backing 110, and comprises make coat 116 in which abrasive particles 118 are embedded and size coat 117 which overlays make coat 116 and abrasive particles 118. Optional supersize 119 overlays size coat 117. Melt flow zone 130*a* is disposed adjacent peripheral edge 132 and melt flow zone 130*b* is adjacent perforation 134. Optional pressure-sensitive adhesive layer 160 is disposed on a second major surface 125 of backing 110 opposite first major surface 115. Optional release liner 170 is disposed on optional pressure-sensitive adhesive layer 160.

Details concerning manufacture of coated abrasive articles having make and size layers are well known in the coated abrasive art may be found, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

In another embodiment, the abrasive particles are dispersed throughout a binder secured to a backing. Such coated abrasive articles may have a desired topography imparted to the abrasive surface. For example, the abrasive layer may comprise shaped abrasive composites, which in some embodiments are precisely-shaped, secured to the backing. Structured abrasive articles fall in this category.

Figure 2:
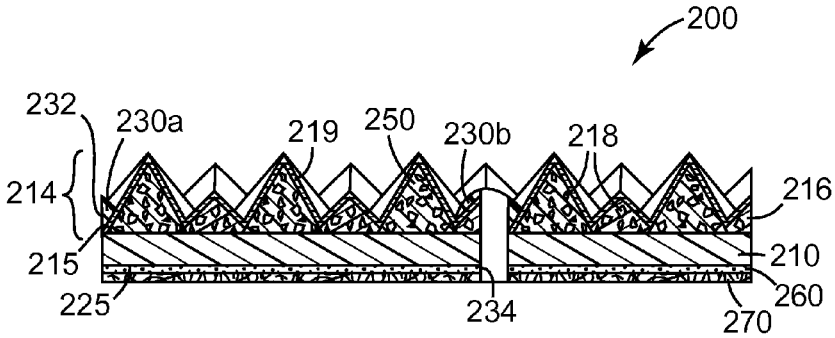
FIG. 2 is a cross-sectional side view of an exemplary coated abrasive article according to the present invention.

Referring now to FIG. 2, a coated abrasive article 200 (a structured abrasive article) has an abrasive layer 214 that comprises shaped abrasive composites 220 secured to first major surface 215 of backing 210. Shaped abrasive composites 220 comprise abrasive particles 218 dispersed in binder 250. Optional supersize 219 overlays abrasive layer 214. Melt flow zone 230*a* is disposed adjacent peripheral edge 232 and melt flow zone 230*b* is adjacent perforation 234. Optional pressure-sensitive adhesive layer 260 is disposed on a second major surface 225 of backing 210 opposite first major surface 215. Optional release liner 270 is disposed on optional pressure-sensitive adhesive layer 260.

Further details concerning such types of coated abrasive articles may be found, for example, in U.S. Pat. No. 5,152,917 (Pieper et al.); U.S. Pat. No. 5,378,251 (Culler et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,851,247 (Stoetzel et al.); U.S. Pat. No. 5,942,015 (Culler et al.); U.S. Pat. No. 6,139,594 (Kincaid et al.); U.S. Pat. No. 6,277,160 (Stubbs et al.); and U.S. Pat. No. 7,344,575 (Thurber et al.).

In general, coated abrasive articles may have abrasive particles of practically any size, but in the case of the coated abrasive articles shown in FIG. 2, the abrasive particles typically have small particle sizes. For example, coated abrasive particles according to the present disclosure may have abrasive particles with an average particle diameter in a range of from at least 3 to 30 micrometers. In such cases, it is especially desirable to keep the height of any melt flow zone smaller than the average particle diameter of the abrasive particles and/or shaped abrasive composites, lest they have reduced abrading efficacy.

Coated abrasive articles according to the present invention can be converted, for example, into belts, tapes, rolls, discs (including perforated discs), and/or sheets. For belt applications, two free ends of the abrasive sheet may be joined together using known methods to form a spliced belt.

In view of the various layers of coated abrasive articles (e.g., as described above), it will be recognized that each component of the coated abrasive article will typically have a distinct infrared absorption spectrum. Accordingly, the ability of each component to absorb infrared radiation supplied by a laser will vary, possibly drastically from component to component. For example, polyethylene terephthalate (PET) polyester (a common backing material) exhibits substantially baseline absorption (i.e., little infrared radiation is absorbed) at a wavelength of 10.6 micrometers, the typical $CO_2$ laser processing wavelength, but has a substantial absorption band covering the wavelength range of from about 9 to 9.3 micrometers, and it also has a weaker absorption band at wavelengths of about 9.8 micrometers.

As used herein, the term "component" refers to one or more adjoining elements that form a portion of a coated abrasive article; for example, a pressure-sensitive adhesive layer or a pressure-sensitive adhesive layer in combination with a release liner and a backing.

To facilitate absorption of infrared radiation at a specific wavelength or wavelengths (e.g., to coincide with a particular laser) one or more of the various components of the coated abrasive article may contain an infrared absorbing material. For example, carbon black and/or another infrared absorber can be included in the adhesive layer, resins/binders, or backing to increase infrared absorption at a particular wavelength. This may be particularly useful in the case of polyethylene terephthalate (PET) polyester, polyethylene, and polypropylene. In one embodiment, the coated abrasive article may be configured such that its constituent parts are arranged by melting temperature or by absorbance at a given infrared wavelength.

The absorption spectrum should generally include at least some portion of the infrared spectrum in order to match the frequency of the infrared laser to an infrared absorbance band, but it need not include the entire infrared spectrum, and it may optionally contain one or more regions of the electromagnetic spectrum at shorter and/or longer wavelengths. Absorption spectra for a wide number of materials are known and catalogued in standard reference works. In addition, absorption spectra for materials not otherwise available can be readily obtained using an infrared spectrometer according to standard techniques. Useful infrared spectrometers include scanning and Fourier Transform Infrared (FTIR) spectrometers, and may measure absorbance by, for example, transmission and/or reflection techniques.

Infrared laser(s) should be chosen such that they operate at a wavelength where the component(s) of the coated abrasive article has/have an absorbance of at least 0.01 per micrometer of thickness of the components, more typically 0.1 per micrometer of thickness, or even at least one per micrometer of the components. For example, in the cases of PET and acrylic resins, the infrared laser may be chosen to operate in a range of from 9.3 to 9.6 micrometers where absorption is typically strong, while in the case of polypropylene, the infrared laser may be chosen to operate in a range of from about 10.28 to 10.3 micrometers.

Any infrared lasers may be used in practice of the present disclosure. The infrared laser(s) may be tunable or fixed wavelength, and/or pulsed or continuous wave (CW). Examples of infrared lasers of sufficient power to ablate material include carbon dioxide ($CO_2$) lasers. Other lasers operating in the infrared wavelength range include, for example, solid state crystal lasers (e.g., ruby, Nd/YAG), chemical lasers, carbon monoxide laser, fiber lasers, and solid state laser diodes. Typically, pulsed infrared lasers (e.g., including ultrafast pulsed lasers) are highly effective as they generally deliver a higher peak irradiance than continuous wave (CW) infrared lasers of equal average power output. $CO_2$ lasers are the second cheapest source of infrared laser photons after diode lasers, and are substantially cheaper than ultraviolet laser alternatives.

In order to provide rapid processing, the infrared laser beam(s) used in practice of the present disclosure typically has an average power of at least 60 watts (W); for example 70 W, 80 W, or 90 W or more. Likewise, a cross-section of the infrared laser beam (i.e., spot size) at a substrate to be cut is desirably very small, typically with an area. For example, the infrared laser beam may be focused to a spot (where the infrared laser beam contacts the coated abrasive article) such that a total of all portions of the spot, having an intensity of at least half of the average beam intensity, has an area of less than or equal to 0.3 square millimeters ($mm^2$), less than about 0.1 $mm^2$, or even less than 0.01 $mm^2$, although smaller and larger spot sizes may also be used. Using the above conditions, it is typically possible to achieve good ablation at trace rates (i.e., the rate at which the beam is scanned across a substrate) of at least 10 millimeters per second (mm/sec), or even at least 20 mm/sec, although slower trace rates may also be used.

Laser ablating of the coated abrasive article may be achieved using a single trace of a laser beam or multiple superposed traces. Multiple laser beams may be used simultaneously or sequentially. If multiple laser beams are used, they may have the same or different wavelengths. In one embodiment, individual components of a coated abrasive article are sequentially removed using infrared laser beams, each tuned to an absorbance band of a respective component (e.g., the backing and the abrasive layer). In another embodiment, individual components of a coated abrasive article are simultaneously removed using multiple infrared laser beams tuned to an absorbance band of separate components of the coated abrasive article (e.g., the backing and the abrasive layer). Additional infrared lasers may also be used; for example, if additional components are present. If multiple infrared laser beams are used, their traces should typically be superposed to achieve maximum benefit, although this is not a requirement.

Absorption of the laser beam may be single-photon or multiphoton absorption. Typically, the absorption is single photon absorption.

Infrared laser ablation may be carried out such that it does not completely penetrate the coated abrasive article, though most typically it cuts completely through. Further, Infrared laser ablation may be carried out from any direction (e.g., from the front (abrasive) surface to the back surface or in the opposite direction) of a coated abrasive article.

Advantageously, typical coated abrasive articles ablated according to the present disclosure are less prone to formation of melt flow features on the exposed surface of the abrasive layer than if ablated using a $CO_2$ laser operating at 10.6 micrometers as is current industry practice.

Figure 3A:
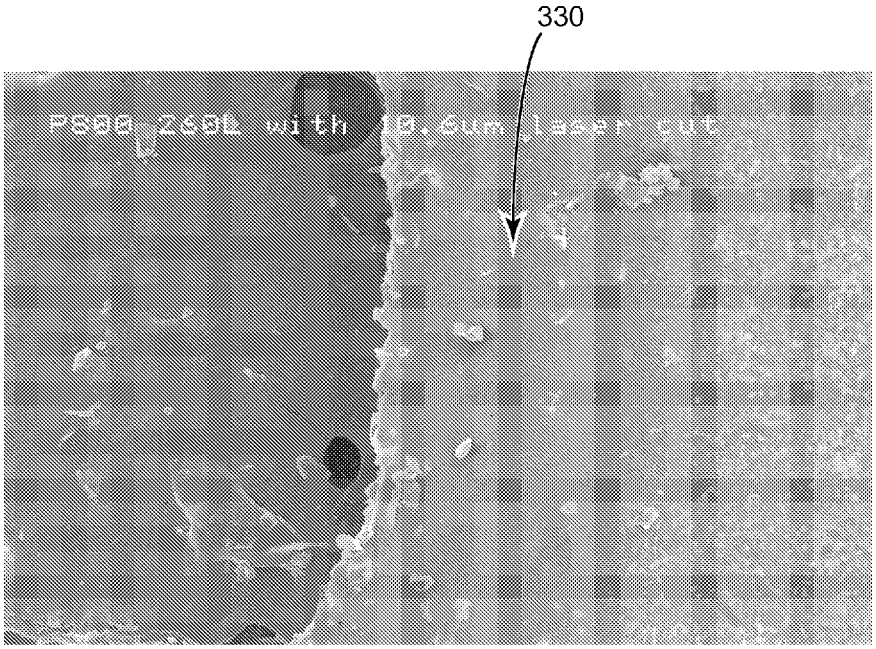
FIGS. 3A-3B are electron micrographs of a comparative coated abrasive article prepared using a $CO_2$ laser operating at a wavelength of 10.6 micrometers.
Figure 3B:
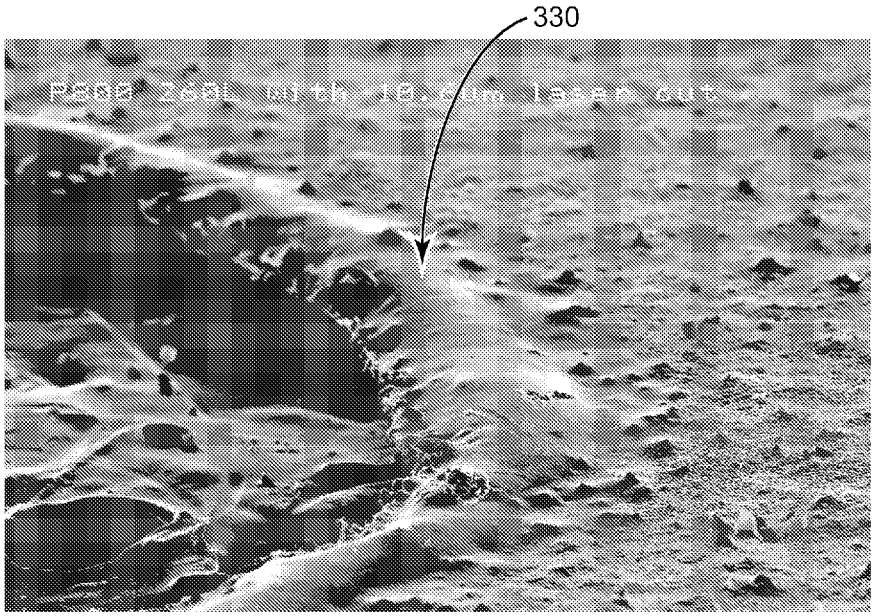
Figure 4A:
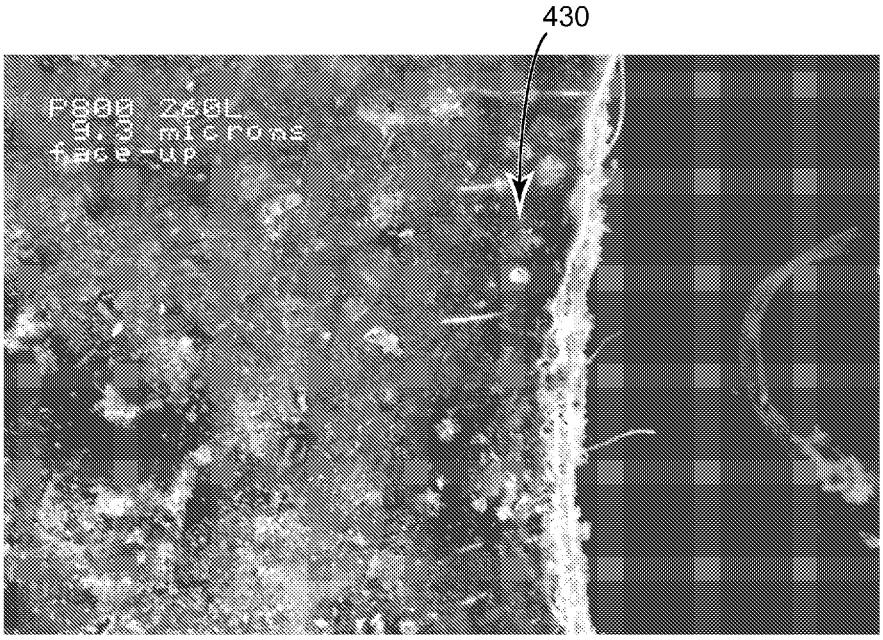
FIGS. 4A-4B are electron micrographs of an exemplary coated abrasive article according to the present disclosure prepared using a $CO_2$ laser operating at a wavelength of 9.3 micrometers.
Figure 4B:
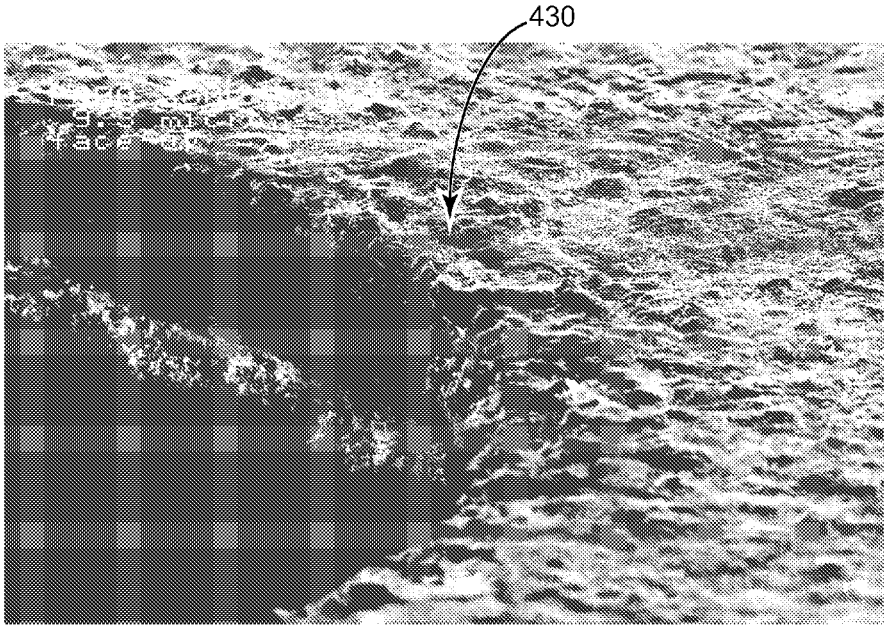

This can be seen, for example, in FIGS. 3A-4B, which show perforated coated abrasive discs as viewed from their abrasive surface sides. FIGS. 3A-3B show results of perforating a 3M 260 L HOOKIT FINISHING FILM DISC (a coated abrasive disc available from 3M Company which includes looped knit fabric adhesively attached to a PET backing, make/size layers, and a zinc stearate supersize) using a $CO_2$ laser (average power: 1 kilowatt; spot size: 0.018 $mm^2$; pulse rate: approximately 10 kiloHertz (kHz); pulse width: approximately 100 microseconds; trace speed=2 meters/second) operating at a wavelength of 10.6 micrometers (Comparative Example A). FIGS. 4A-4B show results of perforating an identical coated abrasive article using the same $CO_2$ laser conditions except that the laser was tuned to a wavelength of 9.3 micrometers (Example 1). In each case, the laser beam impinged on the looped side of the abrasive disc and ablated through to the disc and exited on the abrasive layer side. Referring to FIGS. 3A-3B, it is apparent that the size of melt flow zone 330 formed on for Comparative Example A is substantially larger and more raised than melt flow zone 430 of Example 1 shown in corresponding FIGS. 4A-4B.

According to the methods of the present disclosure, it is possible to laser ablate coated abrasive articles, especially those having a low melting supersize such as, for example, zinc stearate (melting range of 120-130° C.), while reducing the height of raised features formed in melt flow zones. For example, melt flow zones according to the present disclosure may have a maximum width of less than 100 micrometers, less than 80 micrometers or even less than 50 micrometers, and a maximum height of less than 40 micrometers, less than 15 micrometers or even less than 5 micrometers. This may be particularly important for fine grit sizes such as, for example, those coated abrasive discs with a zinc stearate supersize and an abrasive particle size of P800 to P1500 as the abrasive particles may be smaller than raised features of the melt flow zones, leading to wild scratches.

All patents and publications referred to herein are hereby incorporated by reference in their entirety. All examples given herein are to be considered non-limiting unless otherwise indicated. Various modifications and alterations of this disclosure may be made by those skilled in the art without departing from the scope and spirit of this disclosure, and it should be understood that this disclosure is not to be unduly limited to the illustrative embodiments set forth herein.

What is claimed is:

1. A method comprising:

providing a coated abrasive article comprising abrasive particles secured by at least one binder to a first major surface of a backing, wherein the coated abrasive article comprises a pressure-sensitive adhesive layer disposed on a second major surface of the backing opposite the first major surface;

obtaining at least a portion of a first absorption spectrum corresponding to a first component of the coated abrasive article;

providing a first infrared laser beam having a first wavelength matched to a first absorbance band of the first absorption spectrum, wherein the first component has a first absorbance at the first wavelength of at least 0.01 per micrometer of thickness of the coated abrasive article; and ablating a portion of the first component with the first infrared laser beam, wherein infrared laser ablation cuts completely through the coated abrasive article.

2. The method of claim 1, wherein the first infrared laser beam has a first average power of at least 60 watts and a first average beam intensity, wherein the first infrared laser beam is focused to a first spot where the first infrared laser beam contacts the coated abrasive article, wherein a total of all portions of the first spot having an intensity of at least half of the first average beam intensity has an area of less than or equal to 0.3 square millimeters, and wherein the first spot traces a first path on the coated abrasive article at a first rate, relative to the coated abrasive article, of at least 10 millimeters per second.

3. The method of claim 2, further comprising:

obtaining at least a portion of a second absorption spectrum corresponding to a second component of the coated abrasive article;

providing a second infrared laser beam having a second wavelength different than the first wavelength, wherein the second wavelength is matched to a second absorbance band of the second absorption spectrum, wherein the second component has a second absorbance at the second wavelength of at least 0.01 per micrometer of thickness of the second component;

ablating a portion of the second component with the second infrared laser beam.

4. The method of claim 3, wherein the second infrared laser beam has a second average power of at least 60 watts and a second average beam intensity, wherein the second infrared laser beam is focused to a second spot where the second infrared laser beam contacts the coated abrasive article, wherein a total of all portions of the second spot having an intensity of at least half of the second average beam intensity has an area of less than or equal to 0.3 square millimeters, and wherein the second spot traces a second path on the coated abrasive article at a second rate, relative to the coated abrasive article, of at least 10 millimeters per second.

5. The method of claim 3, wherein the second spot traces a second path superposed on the first path.

6. The method of claim 3, wherein the second component comprises at least a portion of the at least one binder.

7. The method of claim 1, wherein the abrasive particles have an average particle diameter in a range of from 3 to 30 micrometers.

8. The method of claim 1, wherein the first infrared laser beam is a pulsed laser beam.

9. The method of claim 1, wherein the coated abrasive article further comprises a pressure-sensitive adhesive layer disposed on a second major surface of the backing opposite the first major surface.

10. The method of claim 1, wherein the first component comprises at least a portion of the backing.

11. A method comprising:

providing a coated abrasive article comprising abrasive particles secured by at least one binder to a first major surface of a backing;

providing a first infrared laser beam having a first wavelength, wherein the coated abrasive article has a first component with a first absorbance at the first wavelength of at least 0.01 per micrometer of thickness of the first component;

ablating a portion of the first component with the first infrared laser beam;

providing a second infrared laser beam having a second wavelength different than the first wavelength, wherein the coated abrasive article has a second component with a second absorbance at the second wavelength of at least 0.01 per micrometer of thickness of the second component; and ablating a portion of the second component with the second infrared laser beam.

12. The method of claim 11, wherein at least one of first infrared laser beam and the second infrared laser beam is a pulsed laser beam.

13. The method of claim 11, wherein:

the first infrared laser beam has a first average power of at least 60 watts and a first average beam intensity, wherein the first infrared laser beam is focused to a first spot where the first infrared laser beam contacts the coated abrasive article, wherein a total of all portions of the first spot having an intensity of at least half of the first average beam intensity has an area of less than or equal to 0.3 square millimeters, and wherein the first spot traces a first path on the coated abrasive article at a first rate, relative to the coated abrasive article, of at least 10 millimeters per second; and the second infrared laser beam has a second average power of at least 60 watts and a second average beam intensity, wherein the second infrared laser beam is focused to a second spot where the second infrared laser beam contacts the coated abrasive article, wherein a total of all portions of the second spot having an intensity of at least half of the second average beam intensity has an area of less than or equal to 0.3 square millimeters, and wherein the second spot traces a second path on the coated abrasive article at a second rate, relative to the coated abrasive article, of at least 10 millimeters per second.

14. The method of claim 13, wherein the second spot travels a second path superposed on the first path.

15. The method of claim 11, wherein the first component comprises at least a portion of the backing.

16. The method of claim 11, wherein the second component comprises at least a portion of the at least one binder.

17. The method of claim 11, wherein the abrasive particles have an average particle diameter in a range of from 3 to 30 micrometers.

18. The method of claim 11, wherein the coated abrasive article further comprises a pressure-sensitive adhesive layer disposed on a second major surface of the backing opposite the first major surface.

* * * * *